United States Patent [19]

Campbell

[11] Patent Number: 4,618,030

[45] Date of Patent: Oct. 21, 1986

[54] LADDER PLATFORM

[76] Inventor: Guy A. Campbell, 1326 S. Main St., Phillipsburg, N.J. 08886

[21] Appl. No.: 641,343

[22] Filed: Aug. 14, 1984

Related U.S. Application Data

[63] Continuation-in-part of Ser. No. 456,582, Apr. 11, 1983, abandoned.

[51] Int. Cl.[4] ..... E06C 7/16

[52] U.S. Cl. ..... 182/121; 248/238

[58] Field of Search ..... 182/121, 122, 120; 248/238

[56] References Cited

U.S. PATENT DOCUMENTS

| | | | |
|---|---|---|---|
| 185,251 | 12/1876 | Mason | 182/121 |
| 1,042,192 | 10/1912 | Boilot | 182/121 |
| 1,352,914 | 9/1920 | Plasclascovitie | 182/121 |
| 2,553,322 | 5/1951 | Kurmer | 182/121 |
| 4,212,371 | 7/1980 | Gaviorno | 182/121 |

FOREIGN PATENT DOCUMENTS

| | | | |
|---|---|---|---|
| 65156 | 8/1975 | Australia | 182/121 |

*Primary Examiner*—Reinaldo P. Machado
*Attorney, Agent, or Firm*—Thomas Adams

[57] ABSTRACT

A platform for a ladder having rungs includes a frame and a step structure. The frame is arranged to detachably attach to at least one of the rungs of the ladder. The step structure is hingeably mounted to the frame for providing a footrest. The step structure is sized to swing upwardly and allow a foothold between the step structure and the frame. This foothold is supported by an intermediate one of the rungs.

9 Claims, 8 Drawing Figures

FIG. 1
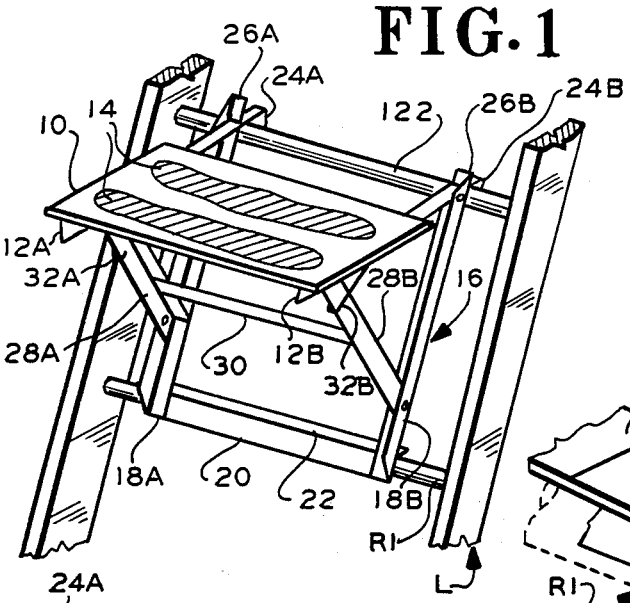
FIG. 7
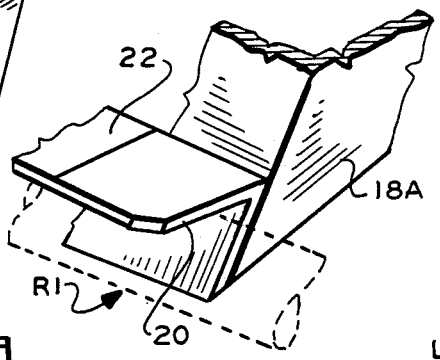
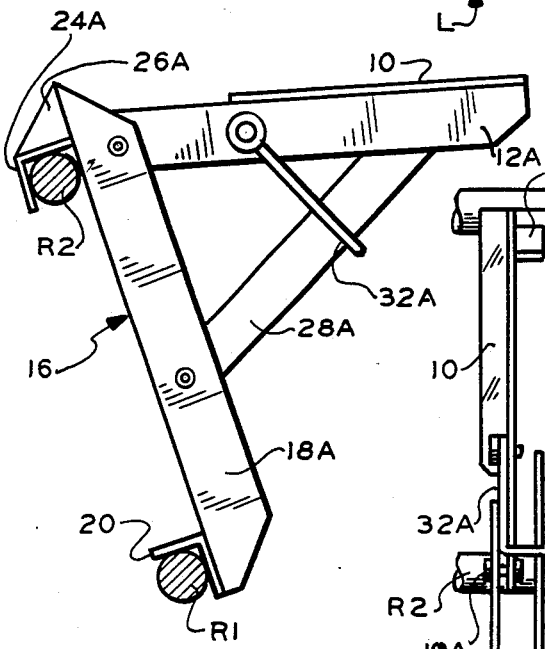
FIG. 2
FIG. 5
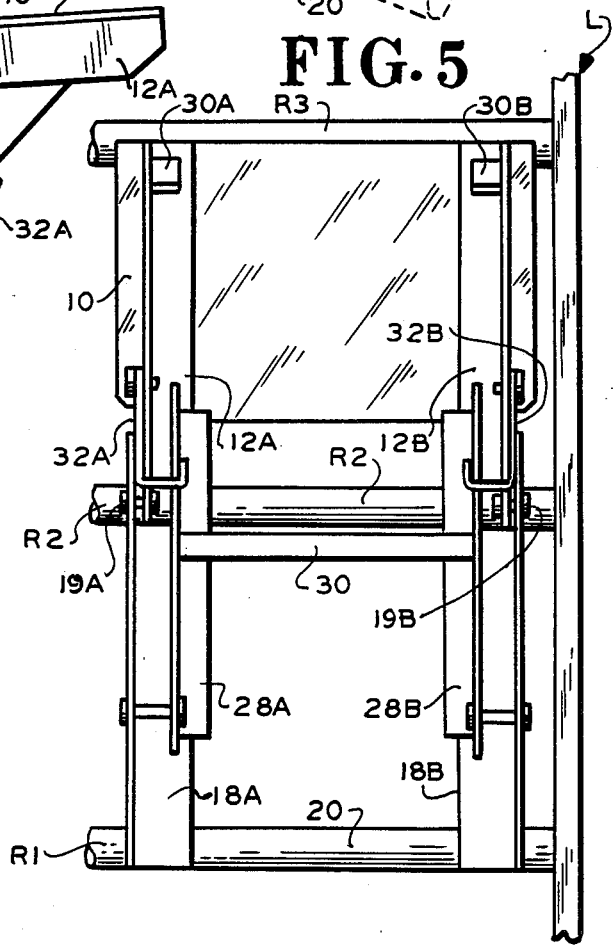

LADDER PLATFORM

BACKGROUND OF THE INVENTION

This is a continuation-in-part of application Ser. No. 456,582 filed Apr. 11, 1983, now abandoned.

The present invention relates to ladder platforms and, in particular, to folding platforms that detachably attach to a ladder.

It is known to provide a braced structure that will hook onto the rungs of a ladder and provide a relatively stable, horizontal platform that a worker can stand on. Such a platform is highly beneficial for a worker who plans to stand on the ladder for an extended period and wishes to distribute the weight evenly across the bottom of his foot to relieve stress and fatigue.

Known ladder platforms have included a structure that hooks at its top to a ladder rung, the platform being hinged at the top of the hooked structure. This known ladder platform also includes a brace hinged at the bottom of the hooked structure and secured against an abutment on the under side of the platform.

A disadvantage with this type of structures is that it blocks access to the rungs. For example, some structures block access to the rung immediately below the rung onto which the ladder platform is hooked. A ladder platform, whether in the operative position or with its platform swung away, should allow access to all rungs of the ladder. Prior structures have not provided this feature.

Also, some ladder platforms do not provide for convenient unfolding. It is desirable to swing the platform away when it is to be transported or when the worker wishes to climb over the platform. Known platforms have either not provided for simple swinging or when swung have blocked access to the rungs.

Accordingly, there is a need for a ladder platform that is simple, reliable and easily moved from one position to another on a ladder. There is also a need for a ladder platform which, when in the working position or swung away, provides access to the rungs so that the worker can pass by the ladder platform.

SUMMARY OF THE INVENTION

In accordance with the illustrative embodiments demonstrating features and advantages of the present invention, there is provided a platform for a ladder having rungs. The platform has a frame and a step means. The frame is arranged to detachably attach to at least one of the rungs of the ladder. The step means is hingeably mounted to the frame for providing a footrest. The step means is sized to swing upwardly and allow a foothold between the step means and the frame. This foothold is supported by an intermediate one of the rungs.

By providing such structure a highly improved ladder platform is achieved. In a prefered embodiment, the ladder platform includes a U-shaped frame having hooks at each of its upper ends and a tread supported by a pair of braces that are hinged to the upper ends of the U-shaped frame. The tread does not cover the full length of the braces so that there is a space between the tread and the frame. When the tread is swung upwardly, this space allows a foothold onto one of the rungs of the ladder.

Also, being U-shaped, the frame provides a foothold upon the lower portion of the frame, which preferably rests upon one of the rungs.

In a highly prefered embodiment, an H-shaped support is pivoted on the bottom of the frame while a pair of hook-like brackets are pivoted on the braces supporting the tread. These hooks slide upon the H-shaped member to pull it upwardly when the tread is swung upward. Thus, the structure when folded upwardly is compact and allows access to all three rungs adjacent to the apparatus.

In the preferred embodiment, the apparatus can be simply used by placing the upper hooks over one rung and folding the tread down. The worker can readily climb atop the tread platform since access is allowed to every rung of the ladder. Significantly, the worker can readily reposition the platform by standing on a rung above the tread platform and swinging it upwardly. Thereafter, the worker can either climb past the apparatus or can with his foot lift the platform up to disengage the apparatus. Thereafter, the apparatus can be placed on another rung.

BRIEF DESCRIPTION OF THE DRAWING

The above brief description as well as other features and advantages of the present invention will be more fully appreciated by reference to the following detailed description of presently preferred but nonetheless illustrative embodiments in accordance with the present invention when taken in conjunction with the accompanying drawings, wherein:

FIG. 1 is a perspective view of a platform according to the principles of the present invention, mounted on the rungs of a ladder;

FIG. 2 is a left side view of the platform of FIG. 1;

FIG. 5 is a front, normal view of the platform of FIG. 4;

FIG. 7 is a detailed perspective view of the lower flanged portion of the frame of FIG. 1.

DETAILED DESCRIPTION OF THE PREFERRED EMBODIMENTS

Figure 3:
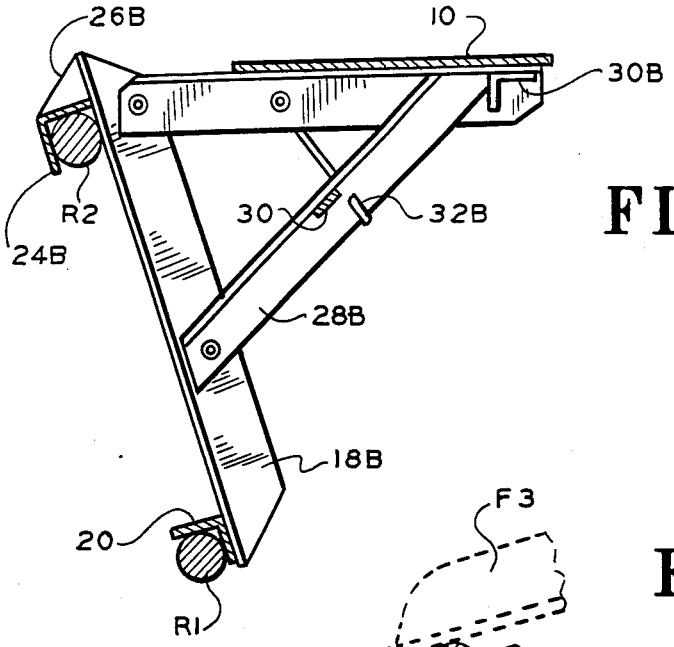
FIG. 3 is a vertical, sectional view of the platform of FIG. 2.

Referring to FIGS. 1, 2, and 3 a platform is shown comprising a step means having a tread 10 supported by a pair of braces 12A and 12B. In this embodiment tread 10 is an aluminum plate, preferably 0.19 inch thick with rounded corners and overall dimensions of 13.75 inches by 8.75 inches. Clearly, other dimensions can be used depending upon the required size of the ladder, the standing area, the strength of a platform, etc. Braces 12A and 12B are aluminum angle irons having their upper flanges directed inwardly and welded to the underside of tread 10.

In this embodiment, a pair of skid-resisting laminates 14 are laid parallel atop tread 10. It will be noted that the downwardly directed flanges of braces 12A and 12B have their front lower corners cut away as well as their rear upper portion (see FIG. 3). Also, the horizontal flanges of braces 12A and 12B are shortened to match the rear, upper-corner cut of the vertical flanges. The overall length of braces 12A and 12B is preferably 12.5 inches, although clearly, other lengths can be used depending upon the size of the structure desired. Also, the outside width of the flanges of braces 12A and 12B is about 2 inches.

A frame is shown herein as U-shaped structure 16, although clearly, other structures can be used (such as, H-shapes, panels with access holes, etc.) The frame 16 has an overall height of 15.75 inches and overall width of 11.75 inches; although, other dimensions can be used depending upon the size of the ladder used and the spacing of the rungs on that ladder. In this embodiment, the upward reaches of frame 16 are formed by parallel aluminum angle irons 18A and 18B that have a flange parallel to the plane of the ladder L and directed inwardly, the other flange being directed outwardly away from the ladder. Both ends of each of these outwardly directed flanges of angle irons 18A and 18B are bevel-cut at 45 degrees. The hinge between braces 12A and 12B and braces 18A and 18B is provided by suitable bolts.

A similarly sized, aluminum angle iron 20 spans the entire width of frame 16 and is welded to the rear side of angle irons 18A and 18B at their lower ends. Angle iron 20 has one flange directed downwardly and the other flange directed toward the rungs of ladder L. The top side of the rearwardly extending flange of angle iron 20 has a skid-resistant laminate 22 secured atop the flange. It will be observed that angle iron 20, being arranged in this fashion, provides a foothold atop rung R1. A detail of the welded joint between angle irons 18A and 20 is given in FIG. 7.

Figure 6:
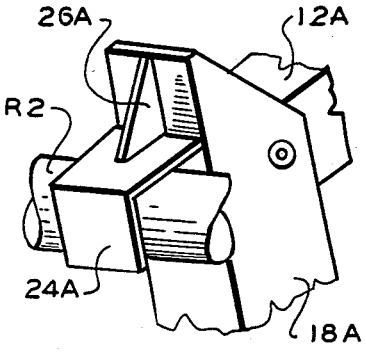
FIG. 6 is a detailed, rear, perspective view of the upper left portion of the hooked frame of FIG. 1.
Figure 8:
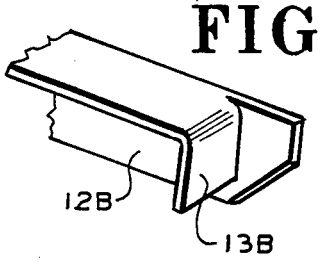
FIG. 8 is a detailed, perspective view of an abutment which is an alternate to that illustrated in FIG. 3.

Each of the upper ends angle irons 18A and 18B have on their rear side a hook 24A and 24B, respectively. A right triangular brace 26A and 26B is welded between the top of the hook 24A and 24B and the rear face of the angle iron 18A and 18B, respectively. A left detail of this hook arrangement is shown in FIG. 6. Hooks 24A and 24B engage an intermediate rung R2. A catch means is shown herein as an H-shaped structure having a pair of struts 28A and 28B connected by a spanner bar 30 welded on the mid-underside of struts 28A and 28b. Struts 28A and 28B are angle irons having an overall length of 13⅛ inches, the flanges of the angle iron being 1.5 inches wide and 3/16 inch thick. Struts 28A and 28B have one flange directed downwardly and the other flange directed inwardly. The downwardly directed flanges are cut at each end at approximately 45 degrees to match braces 18A, 18B, 12A and 12b. The inwardly directed flange of struts 28A and 28B are appropriately shortened due to these 45 degree cuts. The upper point of struts 28A and 28B are blunted as shown in FIG. 3 to provide vertical surfaces that match the vertical surfaces of the abutments, one such abutment shown as a short angle iron 30B, welded to the underside of the horizontal flange of brace 12B at its outer end. It is to be understood that brace 12A has a similar abutment (shown hereinafter in FIG. 5 as abutment 30A). While abutment 30B is shown herein as a separate angle iron, in some embodiments an abutment can be formed by cutting the joint between the flanges of brace 12B and folding the horizontal flange downwardly as shown in FIG. 8 to form an abutment surface 13B.

The overall width of the H-shaped structure is 10.5 inches. Spanner 30 is welded approximately 5 inches from the top of braces 28A and 28B. While an H-shaped structure is shown, clearly other structures are possible, such as U-shaped structures, panels with access holes, etc.

A holding means is shown herein as a pair of brackets 32A and 32B. Brackets 32A and 32B are complementary rods that are formed into a loop at one end and a hook at the lower end. The upper ends of brackets 32A and 32B are pivotably bolted to the outside of the horizontal flanges of braces 12A and 12B. The overall length of brackets 32A and 32B is approximately 5 inches.

Figure 4:
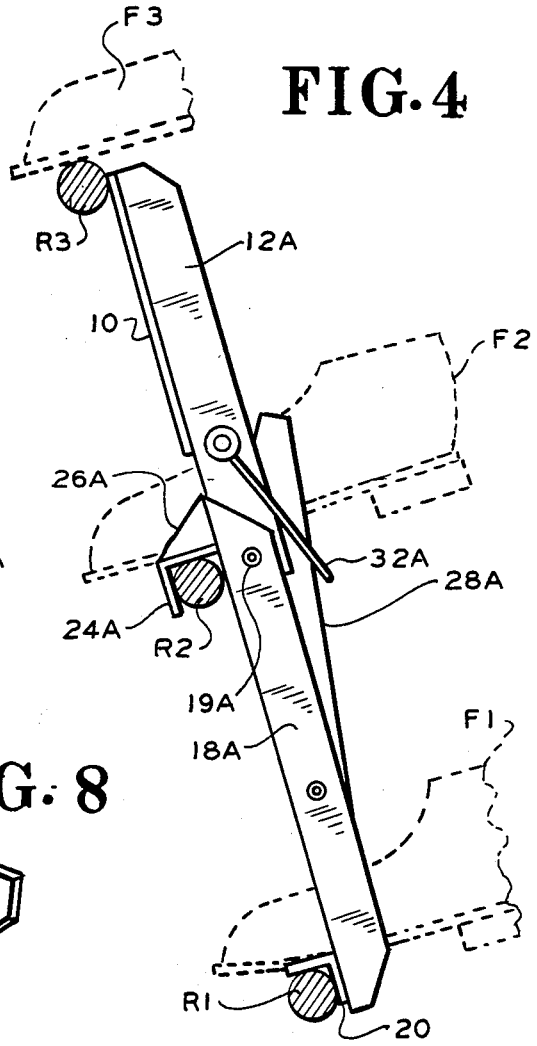
FIG. 4 is a left side view of the platform of FIG. 2 swung into the upward position and illustrating the access to the rungs provided to each rung.

Referring to FIGS. 4 and 5, the platform is shown with tread 10 swung upwardly and resting upon rung R3, which is higher than previously mentioned rungs R1 and R2. Although the illustration suggests that the rung R3 limits the motion of tread 10, in most embodiments the structure of the platform will limit the angular motion of the tread. The braces 12A and 12B are shown herein to pivot on the pivot bolts 19A and 19B, respectively.

To faciliate an understanding of the apparatus of FIGS. 1–8, its operation will be briefly described. The worker may initially configure the platform as shown in FIG. 1 with the support braces 28A and 28B positioned as shown with its upper end against the abutments 30A and 30B (FIGS. 1, 2 and 5). Thus configured, the hook 24A and 24B (FIGS. 1 and 2) may both be placed over intermediate rung R2. The lower flange of angle iron 20 then engages lower rung R1 to give the structure stability. Once so positioned, the worker can climb upon tread 10 by the simple expedient of placing his foot on angle iron 20 which is support by rung R1. Such foot access is possible since the frame 16 (FIG. 1) is an open structure. Once standing upon tread 10, the worker has the weight on his feet evenly distributed by the relatively large area of tread 10, as opposed to the relatively small area of rung R2. If the worker desires to bring the platform to another position, he may step onto rung R3 and place his toe underneath tread 10 and swing it upwardly. This results in the platform being arranged as shown in FIGS. 4 and 5. As the worker swings braces 12A and 12B upwardly about hinge bolt 19A and 19B, brackets 32A and 32B pull support braces 28A and 28B upwardly. This feature is important, since it prevents braces 28A and 28B from falling downward and interferring with the movement of the worker.

As illustrated, especially in FIG. 4, a foot may be inserted through or around the platform so that access is given to rungs R1, R2, and R3. Specifically, foot F1 can rest atop angle iron 20 to provide a foothold. Similarly, a foot F2 may be inserted under tread 10 to provide a foothold, in this instance directly atop rung R2. Finally, foot F3 may be placed directly atop rung R3, since its top surface and beyond the platform.

Since the platform apparatus can be readily passed, the worker may position himself above or below the platform apparatus as he may desire. It is convenient to reposition the platform apparatus by standing below and maually lifting it off the ladder and placing it on the desired rung.

It will be noted that when flatened as shown in FIGS. 4 and 5, the platform apparatus is relatively compact and can be readily carried by the worker.

It will be appreciated that various modifications may be implemented with respect to the above described prefered embodiment. For example, the platform may be formed from different materials, for example, from various rods and tubes and flat stock instead of aluminum angle irons. Furthermore, while a J-shaped hook is shown as a bracket for pulling up the support brace, in some embodiments the support brace may be slidingly secured to the tread by various slot and tongue arrangements. Furthermore, while a lower flange is shown for engaging a lower rung, in some embodiments no flange is necessary. This feature may be significant where the rung-to-rung spacing is expected to vary. While a solid panel is shown for the tread, in some embodiments a grate may be used. Various dimensions and materials used and the shapes described can be altered depending upon the desired size, ladder configuration, rigidity, reliability, speed of operation, weight requirements, etc.

Obviously, many modifications and variations of the present invention are possible in light of the above teachings. It is, therefore, to be understood that within the scope of the appended claims, the invention may be practiced otherwise than as specifically described.

What is claimed is:

1. A platform for a ladder having rungs, comprising:

a frame arranged to detachably attach to an intermediate one of the rungs of said ladder;

a step means hingeably mounted to said frame for providing a footrest, said step means being sized to swing upwardly and allow a foothold between said step means and said frame, said foothold being supported by said intermediate one of said rungs; and catch means coupled between said frame and said step means for preventing the step from folding downwardly against the frame and for allowing the step means to swing upwardly, said catch means including:

(a) at least one strut pivotally mounted to said frame and extending upwardly toward the underside of said step means for supporting it; and holding means for urging said strut upwardly with said step means to allow said strut to fold against said ladder substantially parallel thereto.

2. A platform according to claim 1 wherein said step means comprises:

a thread articulated from an upper portion of said frame to swing from a position transverse to said ladder upwardly to a position adjacent said ladder.

3. A platform according to claim 2 wherein said frame has an opening for providing access to the next one of said rungs below said intermediate one.

4. A platform according to claim 3 wherein said tread is sized to allow access to the next one of said rungs above said intermediate one when said tread is swung upwardly and adjacent to said ladder.

5. A platform according to claim 4 further comprising:

an abutment affixed to the underside of said step means for engaging the upper end of said strut and keeping said steps means from folding downwardly, said holding means including:

a bracket pivotally attached to said frame and slidingly engaging said strut.

6. A platform according to claim 3 wherein said frame comprises:

a U-shaped structure having at both of its upper ends two hooks sized to engage said intermediate one of said rungs.

7. A platform according to claim 6 wherein said step means comprises:

a parallel pair of braces attached to the underside of said tread and extending away from it toward said frame.

8. A platform according to claim 7 wherein said U-shaped structure includes:

a flange extending from the bottom of said U-shaped structure toward said ladder to rest upon the next one of said rungs lower than said intermediate one.

9. A platform according to claim 8 wherein said catch means comprises:

an H-shaped support pivotally attached to said frame and slidingly attached to said step means.

* * * * *